US006935061B2

(12) United States Patent
Thompson

(10) Patent No.: US 6,935,061 B2
(45) Date of Patent: Aug. 30, 2005

(54) TAG HOLDER ASSEMBLY

(75) Inventor: Steven C. Thompson, Elkhart, IL (US)

(73) Assignee: L&P Property Management Company, Southgate, CA (US)

( * ) Notice: Subject to any disclaimer, the term of this patent is extended or adjusted under 35 U.S.C. 154(b) by 0 days.

(21) Appl. No.: 10/303,459

(22) Filed: Nov. 25, 2002

(65) Prior Publication Data

US 2004/0098897 A1 May 27, 2004

(51) Int. Cl.[7] ..... G09F 3/18
(52) U.S. Cl. ..... 40/661.03; 40/658
(58) Field of Search ..... 40/661.03, 642.02, 40/649, 651, 658; 248/225.1, 417; 211/119.003

(56) References Cited

U.S. PATENT DOCUMENTS

| | | | | |
|---|---|---|---|---|
| 1,817,151 A | | 8/1931 | Jarvis | |
| 2,950,554 A | | 8/1960 | Foster | |
| 3,074,194 A | | 1/1963 | Mapson | |
| 4,532,726 A | | 8/1985 | Kenney | |
| 4,942,498 A | | 7/1990 | Toussaint | |
| 5,044,104 A | * | 9/1991 | Hopperdietzel | 40/654.01 |
| 5,392,547 A | | 2/1995 | Mason | |
| 5,394,632 A | | 3/1995 | Gebka et al. | |
| 5,488,793 A | | 2/1996 | Gebka et al. | |
| 5,509,634 A | | 4/1996 | Gebka et al. | |
| 5,899,011 A | | 5/1999 | Brinkman | |
| 6,026,603 A | * | 2/2000 | Kump et al. | 40/661.03 |
| 6,105,295 A | | 8/2000 | Brinkman et al. | |
| 6,409,132 B2 | * | 6/2002 | Heisler et al. | 248/220.22 |
| 6,470,613 B1 | | 10/2002 | Wildrick | |
| 6,571,498 B1 | * | 6/2003 | Cyrluk | 40/661.03 |
| 6,622,410 B2 | * | 9/2003 | Wilkes et al. | 40/654 |

* cited by examiner

*Primary Examiner*—S. Joseph Morano
*Assistant Examiner*—Robert J. McCarry, Jr.
(74) *Attorney, Agent, or Firm*—Michael Best & Friedrich LLP

(57) ABSTRACT

A tag holder assembly is provided for mounting on the edges of a display shelf for retail merchandise. When the assembly is pressed against the shelf, the assembly flexes to permit members of the assembly to rotate into a locked position. This flexion gives rise to forces which reliably secure the assembly to the shelf. In one embodiment, the assembly can be removed by rotating the members to an unlocked position. The assembly can be made as a unitary device including, for example, a living hinge. Alternatively, the assembly can made as two or more separate members. The assembly can also include a projecting member that extends higher than the front surface of the shelf to prevent objects on the shelf from falling off. Significantly, any forces which the objects transmit to the assembly through the projecting member tend to lock the assembly even more securely on the shelf.

46 Claims, 3 Drawing Sheets

TAG HOLDER ASSEMBLY

FIELD OF THE INVENTION

This invention relates generally to shelving moldings, and more particularly to tag holders and tag holder assemblies.

BACKGROUND OF THE INVENTION

Retail products are often displayed for consumers on shelves with a price tag nearby. The price tag should be easy to see. If the consumer cannot immediately find and understand the price tag, he or she may decide against purchasing the product.

In many popular types of retail shelving displays, one or more of the shelves includes a channel of standardized dimensions for holding tags that give prices for or otherwise describe the products displayed on the shelves. The tags can be simply glued to the front surface. However, the tags must eventually be changed and glued tags are difficult to remove.

As an alternative to attaching tags directly to the display shelves, various types of tag holders are commercially available that can be permanently or releasably mounted on display shelves. Permanently mounted tag holders are usually secured with fasteners that require the shelves to be cut, drilled or otherwise disfigured. Previously known releasable tag holders do not disfigure the shelves but are typically dislodged from the shelves by routine impacts that are to be expected in the course of normal retail use.

A need exists for a tag holder assembly that mounts releasably on retail displays without any need for cutting or drilling the shelves and is sufficiently robust to withstand the bumps and blows of retail usage.

SUMMARY OF THE INVENTION

The invention is a tag holder assembly for releasably mounting on a shelf having a front surface that defines a pair of generally parallel edges. When the assembly is placed on the front surface and pressed against the shelf, the assembly and the front surface flex as members of the assembly rotate into a locked position. This flexion gives rise to forces which reliably secure the assembly to the shelf. The assembly can be removed by rotating the members to an unlocked position. The assembly can be made in a unitary construction including, for example, a living hinge. Alternatively, the assembly can made as two or more separate members that pivotably engage with each other.

In the unitary construction, the tag holder includes a top portion, a middle portion and a bottom portion. The top portion is sized and shaped to engage the upper edge of the shelf and the upper edge of a tag for describing, for example, merchandise displayed on the shelf. The bottom portion is adapted to engage the lower edge of the shelf and the lower edge of the tag. With the top and bottom portions engaging the upper and lower edges of the shelf, respectively, the middle portion is moved from an unlocked position to a locked position in which the tag holder is releasably mounted on the shelf. The middle portion may include a flexible material to facilitate its movement into the locking position.

When the tag holder assembly is constructed in the form of separate members, the first member has an upper portion for engaging the upper edge of the shelf and the upper edge of a tag and, also, a lower portion. The second member of the assembly has an upper portion, and a lower portion for engaging the lower edge of the shelf and the lower edge of the tag. The first member lower portion and the second member upper portion cooperate to form a pivot region that permits them to pivot with respect to each other without slipping apart. The first and second members engage the shelf edges, respectively. With the members engaged at the pivot region and pivoting with respect to each other, rotation of the members about the upper and lower shelf edges locks the assembly on to the shelf.

The tag molding of the present invention can add a color accent to the product display. The first member of the assembly can also include a projecting member that extends higher than the front surface of the shelf to prevent objects on the shelf from falling off and to serve as a stop for fronting the product on the shelf. Significantly, any forces which the objects may transmit to the assembly through the projecting member tend to lock the assembly even more securely.

Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

DETAILED DESCRIPTION OF PREFERRED EMBODIMENTS

Figure 1:
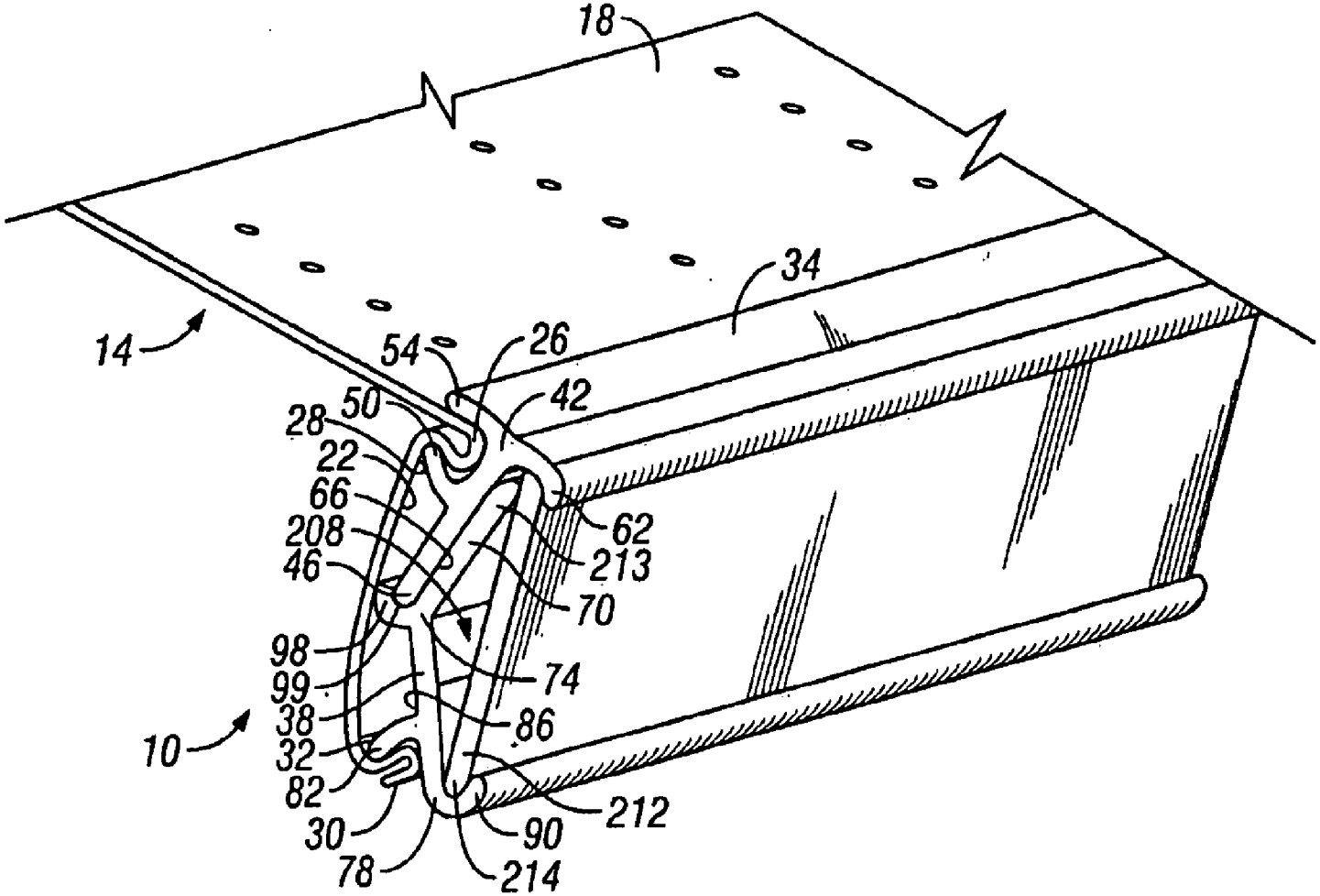
FIG. 1 is a perspective view of a tag holder assembly of the present invention.

In a preferred embodiment, the invention is a tag holder assembly, such as tag holder assembly 10 depicted in FIG. 1. The assembly 10 is shown connected to a shelf 14 of a shelving unit (not shown). The shelf 14 includes a flat upper surface 18 where products (not shown) are displayed, and a channel defining a front surface 22. The front surface 22 includes an upper shoulder or flange 26 having an edge 27 and an undercut 28, and a lower shoulder or flange 30 having an edge 31 and an undercut 32. The front surface 22 serves as connecting structure for mounting the assembly 10. The shelf 14 may be made either of a rigid material such as granite, or flexible material such as rubber, plastic or sheet metal.

Figure 2:
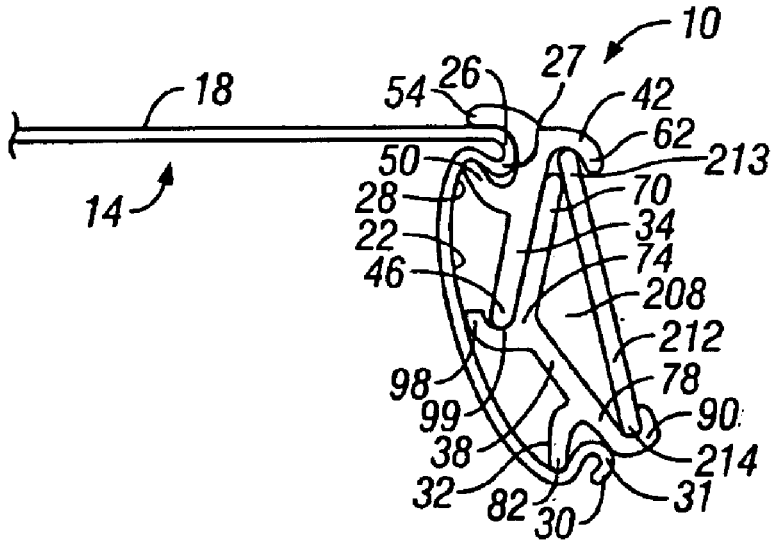
FIG. 2 is a side view of the tag holder assembly of FIG. 1.

As shown in FIGS. 1–2, the tag holder assembly 10 includes a first or upper strip member 34 and a second or lower strip member 38. The first member 34 includes an upper portion 42 and a lower portion 46. The upper portion 42 includes two vertically spaced fingers or inwardly extending portions 50, 54 extending from an inner face 58 of the upper portion 42. Extending portion 54 acts as a stop for fronting products (not shown) on the shelf 14. The upper portion 42 also includes a hook or outwardly extending portion 62 extending from an outer face 66 of the upper portion 42, with the outwardly extending portion 62 curving downwardly, and having an arcuate cross-section. The lower portion 46 of the first member 34 is rounded. The terms "upper," "lower," "outside," "top," "bottom," "under," "over" and the like, as used herein and in the appended claims, are for purposes of describing the relationship of assembly 10 and its component parts to the shelf 14 and the tag 212, and are not intended to imply any particular orientation to the ground or anything else.

The second member 38 includes an upper portion 70, a middle portion 74, and a lower portion 78. The lower portion 78 includes a finger or lower inwardly extending member 82 having an arcuate cross-section extending from an inner face 86 of the lower portion 78. Also, the lower portion 78 includes a hook or outwardly extending portion 90 extending from an outer face 94 of the lower portion 78, with the outwardly extending portion 90 curving upwardly and having an arcuate cross-section. The second member 38 also includes an upwardly facing, arcuate knuckle or upper inwardly extending member 98 at the middle portion 74. The upper portion 70 of the second member 38 is rounded, similar to the lower portion 46 of the first member 34.

Figure 3:
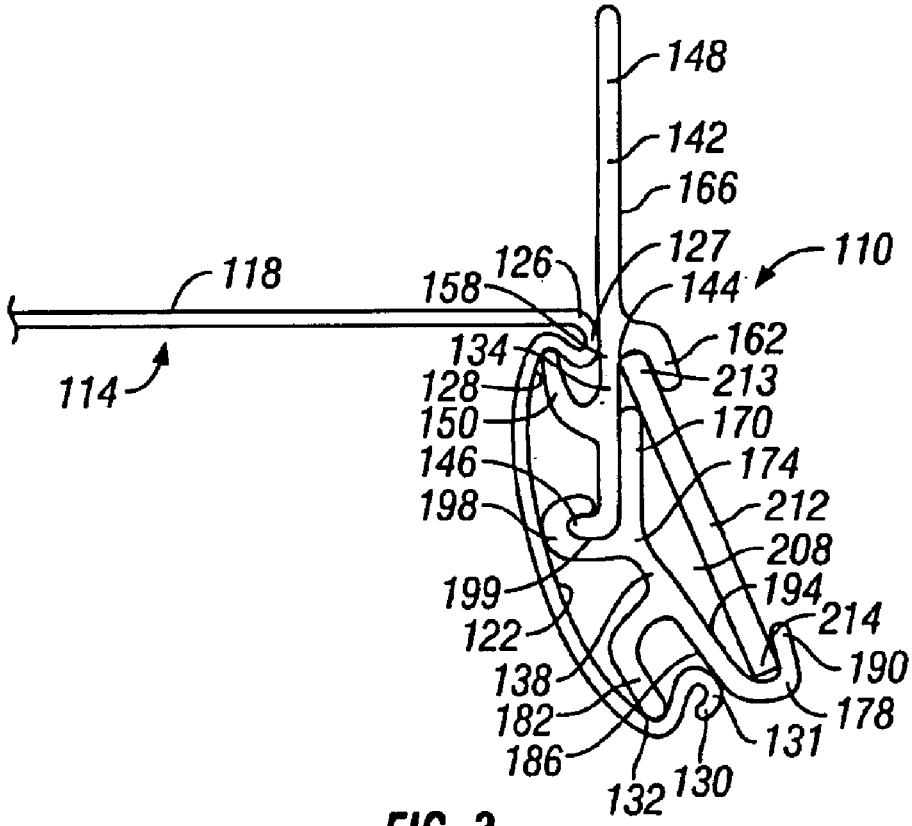
FIG. 3 is a side view of another tag holder assembly of the present invention.

In another preferred embodiment, the invention is assembly 110 as depicted in FIG. 3. Like assembly 10, the molding assembly 110 includes an upper strip member 134 and a lower strip member 138. The upper member 134 includes an upper portion 142, middle portion 144, and a lower portion 146. A substantially flat surface defining a projection or member 148 leads to the upper portion 142. The member 148 extends beyond the flat upper surface 118 of the shelf 114 to help prevent products (not shown) placed upon the flat upper surface 118 from falling. The middle portion 144 includes an upwardly curving, arcuate finger or inwardly extending portion 150 extending from an inner face 158 of the middle portion 144. The middle portion 144 also includes a downwardly curving, arcuate hook or outwardly extending portion 162 extending from an outer face 166 of the middle portion 144. The lower portion 146 of the upper molding member 134 includes a knob-like cross-section.

A second or lower strip member 138 includes an upper portion 170, a middle portion 174, and a lower portion 178. The lower portion 178 includes a finger or lower inwardly extending member 182 having a downwardly curving, arcuate cross-section extending from an inner face 186 of the lower portion 178. Also, the lower portion 178 includes an upwardly curving, arcuate hook or outwardly extending portion 190 extending from an outer face 194 of the lower portion 178. The lower molding member 138 also includes an upwardly curving, arcuate knuckle or upper inwardly extending member 198 at the middle portion 174. The upper portion 170 of the lower molding member 138 is rounded, similar to the upper portion 142 of the upper molding member 134.

Figure 4:
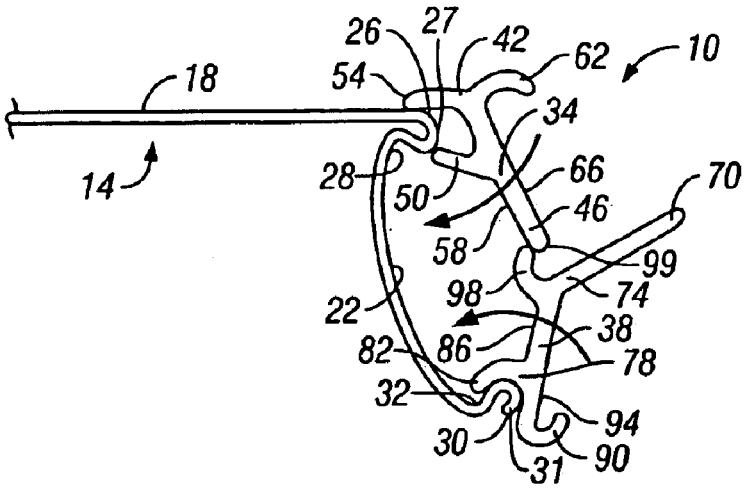
FIG. 4 is a side view of the tag holder assembly of FIG. 1, illustrating the beginning of an attachment sequence to a shelf.
Figure 5:
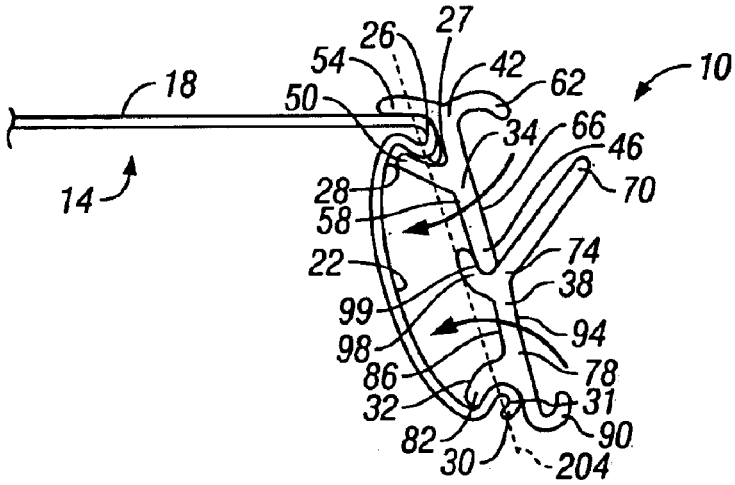
FIG. 5 is a side view of the tag holder assembly of FIG. 1, further illustrating the attachment sequence to the shelf.

FIGS. 4 and 5 depict the assembly 10 in unlocked positions. During assembly to the shelf 14, the first member 34 and second member 38 are positioned relative to the front surface 22 as shown in FIG. 4. Once the upper and lower members 34, 38 are positioned relative to the front surface 22, the members 34, 38 are pivoted toward the front surface 22 such that fingers or inwardly extending portions 50, 54 loosely engage the upper flange 26 at the undercut 28, the lower inwardly extending member 82 loosely engages the lower flange 30 at the undercut 32, and the lower portion 46 of the first member 34 pivotably engages the upper inwardly extending member 98 as shown in FIG. 5. The region of pivotal engagement is referred to as a pivot region 99. Additional force is required to rotate the members 34, 38 about flanges 26, 30, respectively, so as to move the pivot region 99 of assembly 10 in the direction of the front surface 22.

Figure 6:
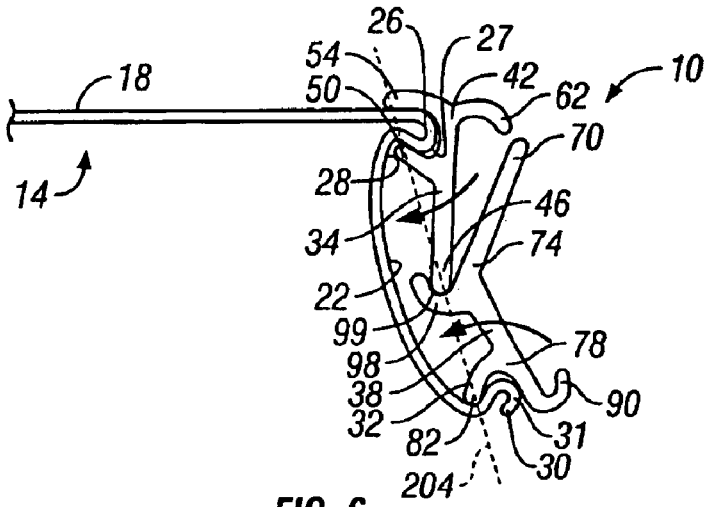
FIG. 6 is a side view of the tag holder assembly of FIG. 1, further illustrating the attachment sequence to the shelf.

As the members 34, 38 are further rotated to move the pivot region 99 toward the front surface 22, the lower portion 46 more firmly engages the upper inwardly extending member 98 until the lower portion 46 is in a plane 204 passing through the extending portion 50 and the extending member 82 as shown in FIG. 6. In the centered position, extending portion 50, lower portion 46 and extending member 82 align so as to present the longest possible distance between extending portion 50 and extending member 82 consistent with pivotable engagement of upper and lower members 34, 38. In the centered position, these three elements are subject to maximum compression so that continued rotation "over center" causes the elements to snap toward front surface 22 and come to rest in a "locked position" as shown in FIGS. 1–2. In the locked position, the fingers or inwardly extending portions 50, 54 firmly engage the upper flange 26 at the undercut 28, the lower inwardly extending member 82 firmly engages the lower flange 30 at the undercut 32, and the lower portion 46 of the first member 34 firmly engages the upper inwardly extending member 98 in the pivot region. The members 34, 38 or portions of the members 34, 38 may or may not be deflected as much compared to the members 34, 38 or portions of the members 34, 38.

Forming (e.g. extruding, molding, etc.) the members 34, 38 from a resilient plastic material such as polypropylene or polyethylene makes it easier to force the pivot region 99 and lower portion 46 past the plane 204. Alternatively, the shelf 14 or the front surface 22 may be made of a resilient material, and therefore may deflect instead of the members 34, 38 during assembly of the members 34, 38. Also, a combination of the molding members 34, 38 and the front surface 22 may deflect upon assembly of the members 34, 38 to the front surface 22. Members 34, 38 may be composed of a brightly-colored material to add a color accent to the display.

In the locked position, the outwardly extending portions 62, 90 define a tag channel 208 therein, such that a tag 212 having an upper edge 213 and a lower edge 214, or multiple tags 212, can be inserted into the tag channel 208. The outwardly extending portions 62, 90 provide protection to the tags 212 so that their accidental or inadvertent removal is difficult. Also, the assembly 10 is securely attached to the front surface 22 so that it is relatively difficult to accidentally dislodge the assembly 10 from the shelf 14 while in the locked position. Extending portion 54 serves as a rail to keep products such as cans on the shelf 14 and as a guide for fronting the products. Any forces that the products may exert on portion 54 tend to reinforce the locking action by causing upper and lower members 34, 38 to rotate toward front surface 22.

To remove the assembly 10 from the front surface 22, the members 34, 38 are forcibly pivoted from the locked position to move the pivot region away from the front face 22. Preferably, extending portion 90 is forced downwardly so as to rotate the members 34, 38 away from the front face 22.

Once the lower portion 46 is in the plane 204, additional force is applied to pivot the members 34, 38 to move the pivot region 99 past the plane 204, and the natural deflection bias of the assembly 10 snaps the assembly 10 to the unlocked position. The members 34, 38 may then be easily relocated and re-assembled to a different shelf 14.

In yet another preferred embodiment (not shown), the molding assembly includes a single-piece molding, such that the fingers or inwardly extending portions engaging the upper and lower flanges and the hooks or outwardly extending portions are part of a unitary device that includes both of the members. A living hinge is positioned towards the middle of the unitary piece to provide the deflection bias of the single-piece molding as the molding traverses between the unlocked position, the relatively unstable orientation, and the locked position. For the present purposes, a "living hinge" is a hinge made of a unitary piece of resilient or elastic material. In still another preferred embodiment (not shown), the molding assembly may include structure to support a sign or other advertising medium larger than the typical price tag.

That which is claimed is:

1. A tag holder for mounting a tag and for mounting on a shelf having a front surface including generally parallel upper and lower edges, the tag holder comprising:

a top portion sized and shaped to engage the upper edge of the shelf and the upper edge of a tag; and a bottom portion sized and shaped to engage the lower edge of the shelf, the bottom portion projecting outwardly to engage the lower edge of the tag;

wherein the top and bottom portions are movable with respect to one another from an unlocked position to a locked position in which the top and bottom portions retain the tag holder on the shelf and in which the top and bottom portions cooperate to restrain the tag against removal from the tag holder.

2. The tag holder of claim 1 wherein the top portion is spaced from the bottom portion to receive the tag between the portions when the tag holder is mounted on the shelf.

3. The tag holder of claim 1 wherein at least one of the top and bottom portions is flexible.

4. The tag holder of claim 1 wherein the top portion includes a member that extends higher than the front surface of the shelf for preventing objects from falling off the shelf.

5. The tag holder of claim 3 wherein the at least one of the top and bottom portions comprises a resilient material.

6. A tag holder assembly for mounting on a shelf having a front surface including generally parallel upper and lower edges, the assembly comprising:

a first member including an upper portion sized and shaped to engage the upper edge of the shelf and the upper edge of a tag; and a lower portion; and a second member including an upper portion and a lower portion sized and shaped to engage the lower edge of the shelf and the lower edge of the tag;

wherein, the first member lower portion and the second member upper portion are sized and shaped to pivotally engage each other; and wherein, with the first member upper portion engaging the upper shelf edge, the second member lower portion engaging the lower shelf edge, and the lower portion of the first member and the upper portion of the second member pivotally engaging each other, the first and second members can be rotated about the upper and lower shelf edges, respectively, from an unlocked position to a locked position in which the first and second members cooperate to retain the assembly on the shelf.

7. The assembly of claim 6 wherein the first member lower portion is unitary with the second member upper portion.

8. The assembly of claim 6 wherein the first member lower portion is hinged with the second member upper portion.

9. The assembly of claim 6 wherein the first member upper portion and the second member lower portion are sized and spaced to hold a tag between the portions when the assembly is mounted on the shelf.

10. The assembly of claim 6 wherein the first member lower portion abuts the front surface of the shelf when the assembly is mounted on the shelf.

11. The assembly of claim 6 wherein the second member upper portion abuts the front surface of the shelf when the assembly is mounted on the shelf.

12. The assembly of claim 6 wherein the first member includes a member that extends higher than the front surface of the shelf for preventing objects from falling off the shelf.

13. The assembly of claim 6 wherein the front surface comprises a flexible material.

14. The assembly of claim 6 wherein the first member comprises a flexible material.

15. The assembly of claim 6 wherein the second member comprises a flexible material.

16. The assembly of claim 6 wherein the first member upper portion comprises an inwardly extending portion to engage the upper edge of the shelf and an outwardly extending portion to engage the upper edge of the tag.

17. The assembly of claim 6 wherein the second member lower portion comprises an inwardly extending portion to engage the lower edge of the shelf and an outwardly extending portion to engage the lower edge of the tag.

18. A tag holder assembly for mounting on a shelf having a front surface including generally parallel upper and lower edges, the assembly comprising:

a first member including an inner face, an outer face, an upper edge and a lower edge;

an inwardly extending upper portion to engage the upper edge of the shelf; and an outwardly extending upper portion to engage the upper edge of a tag; and a second member including an inner face, an outer face, an upper edge and a lower edge;

an outwardly extending upper portion and an inwardly extending upper portion, the second member upper portions cooperating to engage the lower edge of the first member;

an inwardly extending lower portion to engage the lower edge of the shelf; and an outwardly extending lower portion to engage the lower edge of the tag;

wherein, the first member lower edge and the second member upper edge are sized and shaped to pivotally engage each other; and wherein, with the first member inwardly extending upper portion engaging the upper shelf edge, the second member inwardly extending lower portion engaging the lower shelf edge, and the first member lower edge and the second member upper edge pivotally engaging each other, the first and second members can be rotated about the upper and lower shelf edges, respectively, from an unlocked position to a locked position in which the first and second members cooperate to retain the assembly on the shelf.

19. The assembly of claim 18 wherein the first member lower edge is unitary with the second member upper edge.

20. The assembly of claim 18 in the first member lower edge is hinged with the second member upper edge.

21. The assembly of claim 18 wherein the first member outwardly extending upper portion and the second member outwardly extending lower portion are sized and spaced to hold a tag between the portions when the assembly is mounted on the shelf.

22. The assembly of claim 18 wherein the first member outwardly extending upper portion is arcuate and concave toward the second member, and the second member outwardly extending lower portion is arcuate and concave toward the first member when the assembly is mounted on the shelf.

23. The assembly of claim 18 wherein the second member upper inner portion abuts the front surface when the assembly is releasably mounted on the shelf.

24. The assembly of claim 18 wherein the first member includes a member that extends higher than the front surface for preventing objects from falling from the shelf.

25. The assembly of claim 24 wherein the member extends from the first member upper edge, so that a force exerted on the member by an object on the shelf tends to rotate the first member toward the locked position.

26. The assembly of claim 18 wherein the front surface of the shelf comprises a flexible material.

27. The assembly of claim 18 wherein the first member comprises a flexible material.

28. The assembly of claim 18 wherein the second member comprises a flexible material.

29. A tag holder assembly for mounting on a shelf having a front surface including generally parallel first and second flanges, the assembly comprising:

a first member including an upper edge and a lower edge;

an inner projection adjacent the upper edge to engage the first flange; and an outer projection adjacent the upper edge to engage the upper edge of a tag; and a second member including an upper edge and a lower edge;

two inner projections, an upper inner projection adjacent the upper edge, and a lower inner projection adjacent the lower edge to engage the second flange; and an outer projection adjacent the upper edge;

wherein the first member lower edge and the second member upper edge are sized and shaped to pivotably engage each other; and wherein, with the first member upper inner projection engaging the first flange, the second member lower inner projection engaging the second flange, and the first member lower edge and the second member upper edge pivotably engaging each other, the first and second members can be rotated about the first flange and second flanges, respectively, from an unlocked position to a locked position in which the first and second members cooperate to retain the assembly on the shelf.

30. The assembly of claim 29 wherein the first member lower edge is unitary with the second member upper edge.

31. The assembly of claim 29 wherein the lower edge of the first member is hinged with the upper portion of the second member.

32. The assembly of claim 29 wherein the second member upper outer projection includes a generally planar surface that abuts the first member outer face when the assembly is mounted on the shelf.

33. The assembly of claim 29 wherein the first member upper outer projection forms a groove that faces the second member when the assembly is mounted on the shelf.

34. The assembly of claim 33 wherein the second member lower outer projection forms a groove that faces the first member when the assembly is mounted on the shelf.

35. The assembly of claim 34 wherein the first member groove and the second member groove are sized and spaced to hold a tag when the assembly is mounted on the shelf.

36. The assembly of claim 29 wherein the second member upper inner projection abuts the front surface when the assembly is mounted on the shelf.

37. The assembly of claim 29 wherein the front surface comprises a flexible material.

38. The assembly of claim 29 wherein the first member comprises a flexible material.

39. The assembly of claim 29 wherein the second member comprises a flexible material.

40. The assembly of claim 29 wherein each of the flanges includes an undercut, and wherein the first member inner projection engages the first flange undercut and the second member inner projection engages the second flange undercut.

41. The assembly of claim 29 wherein one of the first member lower edge and the second member upper edge includes a protuberance and the other of the first member lower edge and the second member upper edge includes a hollow, and wherein the first member lower edge and the second member upper edge are pivotably engaged when the protuberance is inserted in the hollow.

42. A method for mounting a tag holder assembly to a shelf having a front surface that defines generally parallel first and second edges, the method comprising:

engaging a first member with the first edge of the shelf;

engaging a second member with the second edge of the shelf;

pivotally engaging the first member with the second member; and rotating the first and second members about the first and second edges, respectively, from an unlocked position to a locked position in which the first and second members cooperate to retain the assembly on the shelf.

43. The method of claim 42 wherein the first member has a lower edge that is unitary with an upper edge of the second member.

44. The method of claim 42 wherein the first member has a lower edge that is hinged with the upper edge of the second member.

45. The method of claim 42 wherein the first member and the second member each have a groove, and the grooves are sized and spaced to hold a tag between the grooves when the assembly is mounted on the shelf.

46. The method of claim 42, wherein a tag is removable from the first and second members when the first and second members are in the unlocked position, the method further comprising restraining the tag against removal from the first and second members by rotating the first and second members to the locked position.

* * * * *